US006497467B2

(12) United States Patent
Suwa et al.

(10) Patent No.: US 6,497,467 B2
(45) Date of Patent: Dec. 24, 2002

(54) INKJET PRINTER, AND METHOD AND APPARATUS FOR CONTROLLING INKJET PRINTER

(75) Inventors: Tetsuya Suwa, Kanagawa (JP); Fumihiro Goto, Kanagawa (JP); Akitoshi Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/988,448

(22) Filed: Nov. 20, 2001

(65) Prior Publication Data

US 2002/0075341 A1 Jun. 20, 2002

(30) Foreign Application Priority Data

| | | |
|---|---|---|
| Nov. 30, 2000 | (JP) | 2000-365338 |
| Dec. 26, 2000 | (JP) | 2000-395852 |
| Nov. 1, 2001 | (JP) | 2001-336815 |

(51) Int. Cl.[7] ..... B41J 2/205
(52) U.S. Cl. ..... 347/15; 347/43
(58) Field of Search ..... 347/15, 43, 14, 347/40, 16, 41

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/65 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,373,368 A | * | 12/1994 | Taniguro | 347/14 |
| 5,442,385 A | * | 8/1995 | Moon et al. | 347/43 |
| 5,633,663 A | | 5/1997 | Matsubara et al. | 347/41 |
| 6,089,697 A | * | 7/2000 | Tajika et al. | 347/43 |
| 6,130,685 A | | 10/2000 | Matsubara et al. | 347/41 |
| 6,142,605 A | * | 11/2000 | Serra et al. | 347/43 |
| 6,213,584 B1 | * | 4/2001 | Noyes et al. | 347/40 |

FOREIGN PATENT DOCUMENTS

| | | |
|---|---|---|
| JP | 59-123670 | 7/1984 |
| JP | 59-138461 | 8/1984 |
| JP | 6-6357 | 1/1994 |

* cited by examiner

*Primary Examiner*—Lamson Nguyen
(74) *Attorney, Agent, or Firm*—Fitzpatrick, Cella, Harper & Scinto

(57) ABSTRACT

When an image is printed on a print medium in multi-pass printing by scanning a printhead, having a plurality of nozzles, relatively to the print medium, and ejecting ink in accordance with image data, it is determined whether or not a density of the image data is higher than a predetermined value. An image, in which it is determined to have a density higher than the predetermined value, is printed while the printhead is reciprocally scanned, whereas an image, in which it is determined to have a density lower than the predetermined value, is printed while the printhead is scanned in one direction.

20 Claims, 12 Drawing Sheets

701
FORWARD
BACKWARD
FORWARD
BACKWARD
710
SHEET CONVEYANCE DISTANCE
700
703
704
705
706
FIRST PASS
SECOND PASS
THIRD PASS
FOURTH PASS

FIG. 8A

| | | | | | | | |
|---|---|---|---|---|---|---|---|
| 4 | 3 | 4 | 3 | 4 | 3 | 4 | |
| 1 | 2 | 1 | 2 | 1 | 2 | 1 | |
| 4 | 3 | 4 | 3 | 4 | 3 | 4 | |
| 1 | 2 | 1 | 2 | 1 | 2 | 1 | 2 |

FIG. 8B

| | | | | | | | |
|---|---|---|---|---|---|---|---|
| 4 | 3 | 1 | 2 | 3 | 1 | 2 | 4 |
| 1 | 2 | 4 | 3 | 4 | 2 | 1 | 3 |
| 4 | 1 | 4 | 3 | 2 | 3 | 4 | 1 |
| 3 | 2 | 2 | 1 | 4 | 1 | 3 | 2 |

INKJET PRINTER, AND METHOD AND APPARATUS FOR CONTROLLING INKJET PRINTER

FIELD OF THE INVENTION

The present invention relates to an inkjet printer which performs printing by moving an inkjet printhead relatively to a print medium, and a method and apparatus for controlling the inkjet printer.

BACKGROUND OF THE INVENTION

An inkjet printer, which prints an image on print paper by scanning an inkjet head having a plurality of nozzles, employs a multi-pass printing method which reciprocally scans the inkjet head plural numbers of times for printing one area in order to achieve high-quality printing.

An inkjet printer of this type, which prints an image by reciprocally scanning a printhead, is known to cause a deviation cockling of a dot position depending on the printhead's scanning direction at the time of discharging an ink droplet from the printhead onto a print medium, due to variations of a space between the printhead and a print medium such as a print sheet. It is also a known fact that, when an ink droplet (main ink droplet) is discharged from the inkjet printhead, a droplet called a satellite is discharged posterior to the main ink droplet, and recorded as a satellite dot on the periphery of a main dot recorded by the main ink droplet. The apparatus is usually adjusted so that the satellite dot is recorded over the main dot. However, there is a possibility that the positions of the main dot and satellite dot may deviate under various conditions.

While such problems occur, if printing is performed in one direction, the position where cockling occurs or the position where the satellite dot is printed is usually kept in one direction. Therefore, dot uniformity of a printed image is maintained to a certain degree. However, in a case where an image is printed by reciprocal scanning of a printhead in multi-pass printing for the purpose of print-time reduction, the aforementioned position where cockling occurs or the position where the satellite dot is printed differs in the forward scan and returning (backward) scan, causing to lose uniformity of an image.

SUMMARY OF THE INVENTION

The present invention has been proposed in view of the foregoing conventional example, and has as its object to provide an inkjet printer which enables to print a high-quality image by eliminating an influence of the aforementioned cockling or satellite or the like when an image is printed by multi-pass printing where an inkjet printhead is reciprocally scanned, and to provide a method and apparatus for controlling the inkjet printer.

Another object of the present invention is to provide an inkjet printer, and a method and apparatus for controlling the inkjet printer such that printing is performed while a printhead scans in a predetermined direction in accordance with the type of an image, so as to reproduce clear edges of an image, such as a character or the like.

Furthermore, another object of the present invention is to provide an inkjet printer, and a method and apparatus for controlling the inkjet printer which enables high-quality image printing by printing a relatively light portion of an image, where print dots are distributed, while a printhead scans in one direction, and printing a high-density portion of an image, where dots are dense, while the printhead scans reciprocally.

According to the present invention, the foregoing objects are attained by providing an inkjet printer for scanning an inkjet head having a plurality of nozzles arrayed in a first direction, in a second direction crossing the first direction, and for printing an image on a print medium in relative scanning of the inkjet head, comprising determination means for determining whether or not a density value of an image data is higher than a predetermined value, and selection means for selecting either a first print mode or a second print mode, wherein in the first print mode, printing is performed in bi-directional scanning and in the second print mode, printing is performed in unidirectional scanning, wherein in a case where the determination means determines the density value of the image data is higher than the predetermined value, the selection means selects the first print mode, and in a case where the determination means determines the density value of the image data is not higher than the predetermined value, the selection means selects the second print mode.

According to the present invention, the foregoing objects are attained by providing an inkjet printing method for scanning an inkjet head having a plurality of nozzles arrayed in a first direction, in a second direction crossing the first direction, and for printing an image on a print medium in relative scanning of the inkjet head, comprising a determination step of determining whether or not a density value of an image data is higher than a predetermined value, and a selection step of selecting either a first print mode or a second print mode, wherein in the first print mode, printing is performed in bi-directional scanning and in the second print mode, printing is performed in unidirectional scanning, wherein in a case where in the determination step, it is determined that the density value of the image data is higher than the predetermined value, in the selection step, the first print mode is selected, and in a case where in the determination step, it is determined that the density value of the image data is not higher than the predetermined value, in the selection step, the second print mode is selected.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 8A and 8B are explanatory views of dot assignment for each pass according to a second embodiment of the present invention;

DETAILED DESCRIPTION OF THE PREFERRED EMBODIMENTS

Characteristics of an inkjet printer, and a method and apparatus for controlling the inkjet printer according to an embodiment of the present invention are now briefly described. In an inkjet printer which performs printing by converting inputted R, G and B image data to areal tonality data, such as density pattern data, and quantizing the density pattern data for multi-pass printing, in a case where a density of the pattern data expressed in areal tonality is higher than a predetermined density, the corresponding image area is printed by multi-pass printing where a printhead is reciprocally scanned, because the aforementioned cockling or a satellite is not likely to stand out in the image. On the other hand, in a case where a density of the pattern data expressed in areal tonality is lower than a predetermined density, the corresponding image area is printed by one-way scanning where a printhead is scanned, for instance, in the forward direction, because the aforementioned cockling or a satellite is likely to stand out in the image. Furthermore, in a case of printing an image such as a character image, whose edges are to be clearly reproduced, printing is performed only when the printhead scans in a predetermined direction, e.g., forward direction. By virtue of this, cockling or a satellite always appears on the same side of an image, thus clearly printing edges of the image.

Furthermore, the inkjet printer of the present invention performs the aforementioned multi-pass printing in a way that pixels are interpolated in each pass of the printing, and performs image data correction in each pass based on correction data provided for each pass and prints the corrected image data, thereby enabling high-quality printing.

Hereinafter, preferred embodiments of the present invention are described in detail in accordance with the accompanying drawings.

Figure 1:
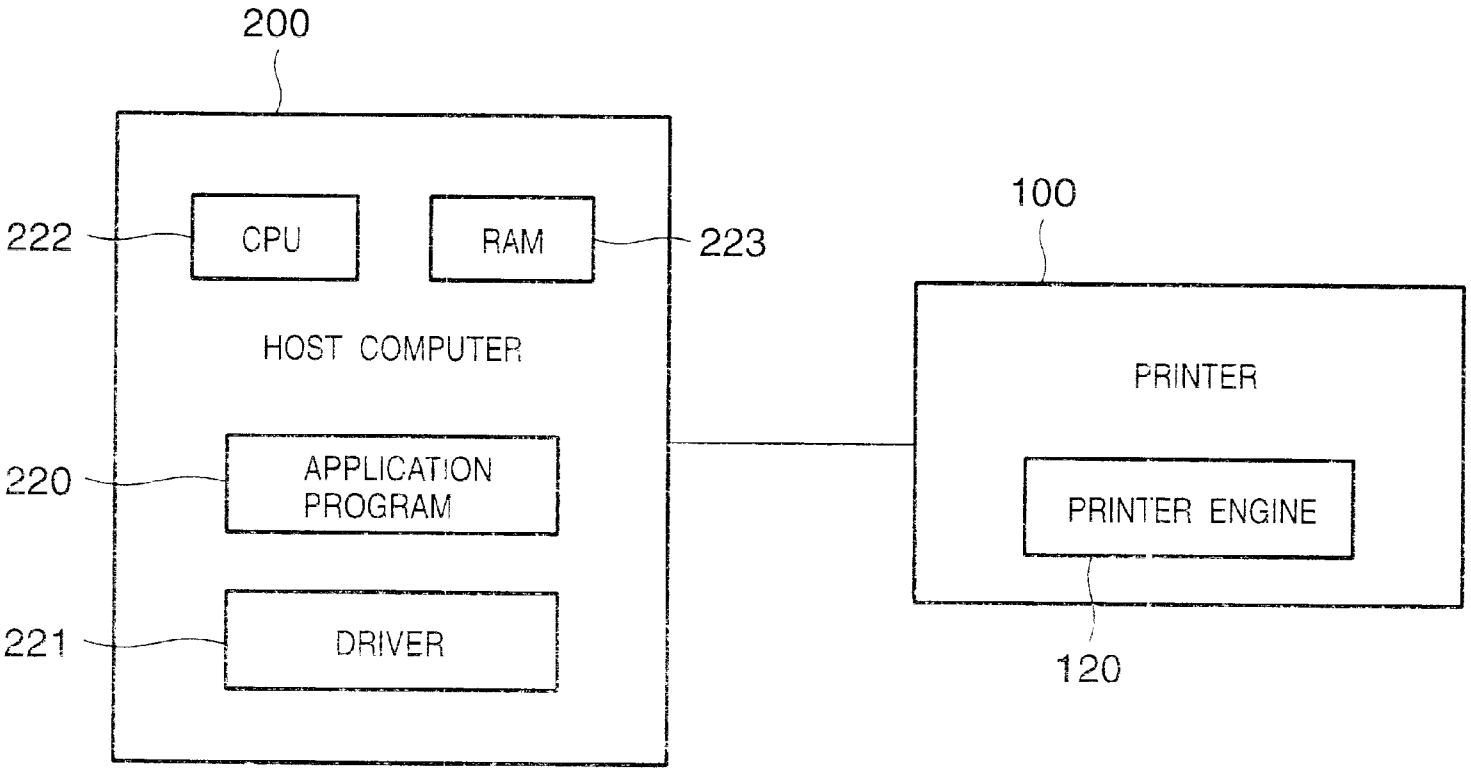
FIG. 1 is a block diagram showing a brief construction of an inkjet printing system according to an embodiment of the present invention.

FIG. 1 is a block diagram showing a brief construction of an inkjet printing system according to an embodiment of the present invention.

In FIG. 1, reference numeral 100 denotes an inkjet printer according to the embodiment, which comprises a printer engine 120 for printing an image by an inkjet method. The printer engine 120, provided for color printing, includes plural printheads (inkjet heads) which discharge ink corresponding to Y, M, C and K, and realizes printing of an image on a print sheet by reciprocally scanning the plural printheads. The construction of the inkjet printer 100 will be described later in detail with reference to FIGS. 3 and 4.

Reference numeral 200 denotes a host computer which stores in hard disk (not shown) various application programs 220 and printer driver 221 for the inkjet printer 100. The inkjet print control method according to the present embodiment may be executed by the inkjet printer 100 or printer driver 221. The printer driver 221, provided by a manufacturer of the printer 100 in the form of a storage medium such as CD-ROM, is installed in the hard disk of the host computer 200. When the printer driver 221 is executed, it is loaded to RAM 223 of the host computer 200 and executed under the control of a CPU 222.

The printer 100 receives print data transmitted by the printer driver 221, and prints an image by a designated printing method, for instance, multi-pass printing. The inkjet printer 100 has mask data for determining dot positions to be printed in each scan of an inkjet head. Therefore, dot positions (nozzles) to be printed in each pass are determined according to the mask data. Note that the host computer 200 may have the mask data, and the printer 100 may simply perform printing based on received print data.

Figure 2:
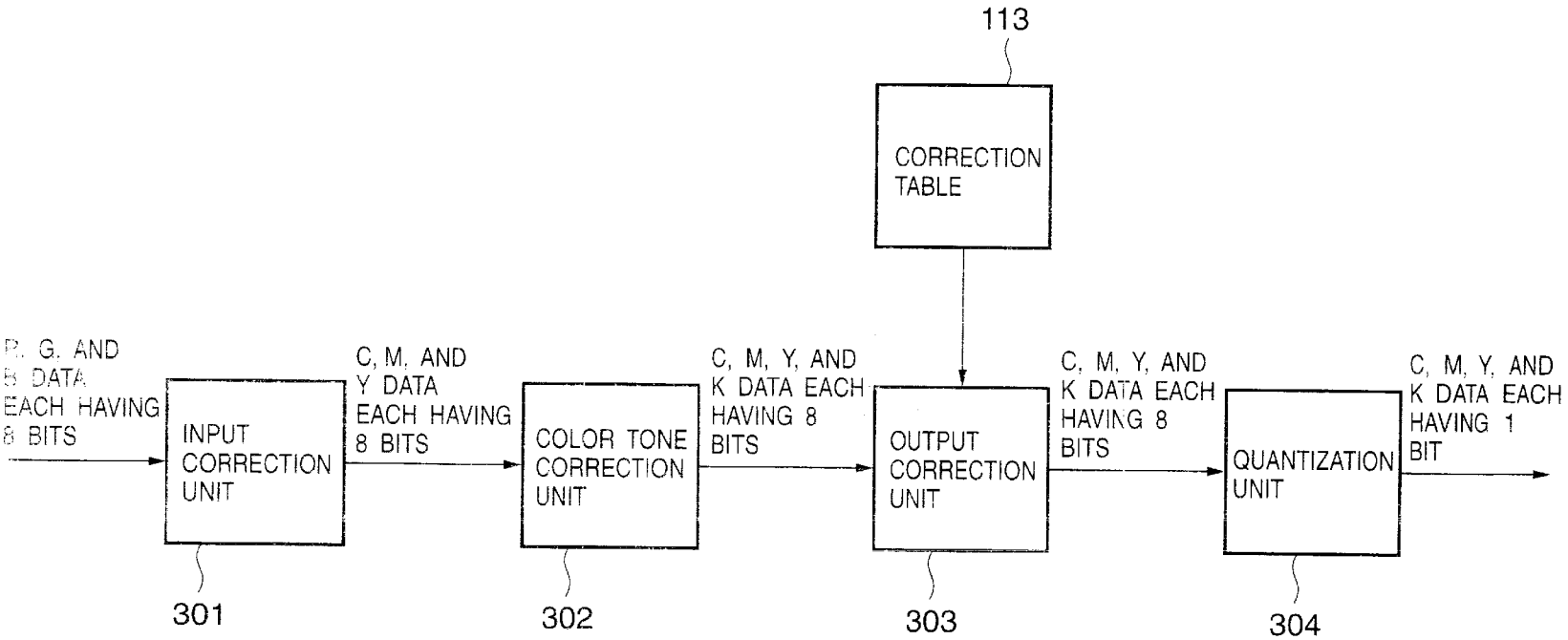
FIG. 2 is a block diagram showing a functional configuration of an image processing unit of a printer driver according to an embodiment of the present convention.

FIG. 2 is a block diagram showing a construction for explaining image processing of the printer driver 221 according to the embodiment.

In FIG. 2, reference numeral 301 denotes an input correction unit which receives input image data expressed in R, G and B each having 8 bits, which is inputted from the application program 220 or the like, and converts the image data to cyan (C), magenta (M), and yellow (Y) data each having 8 bits to be used for printing. Reference numeral 302 denotes a color tone correction unit which generates C, M, Y and K (black) data based on the C, M, and Y data corrected by the input correction unit 301 and outputs the generated data. Reference numeral 303 denotes an output correction unit, which is the characteristic part of the present embodiment, for determining a value of image data to be printed in each pass of the inkjet head. In this case, the output correction unit 303 may correct data to be printed in each pass based on correction data of a correction table 113. Reference numeral 304 denotes a quantization unit which quantizes C, M, Y, and K image data each having 8 bits, outputted by the output correction unit 303, by an error diffusion method or the like and outputs the quantized C, M, Y and K data (print data) each having 1 bit.

Figure 3:
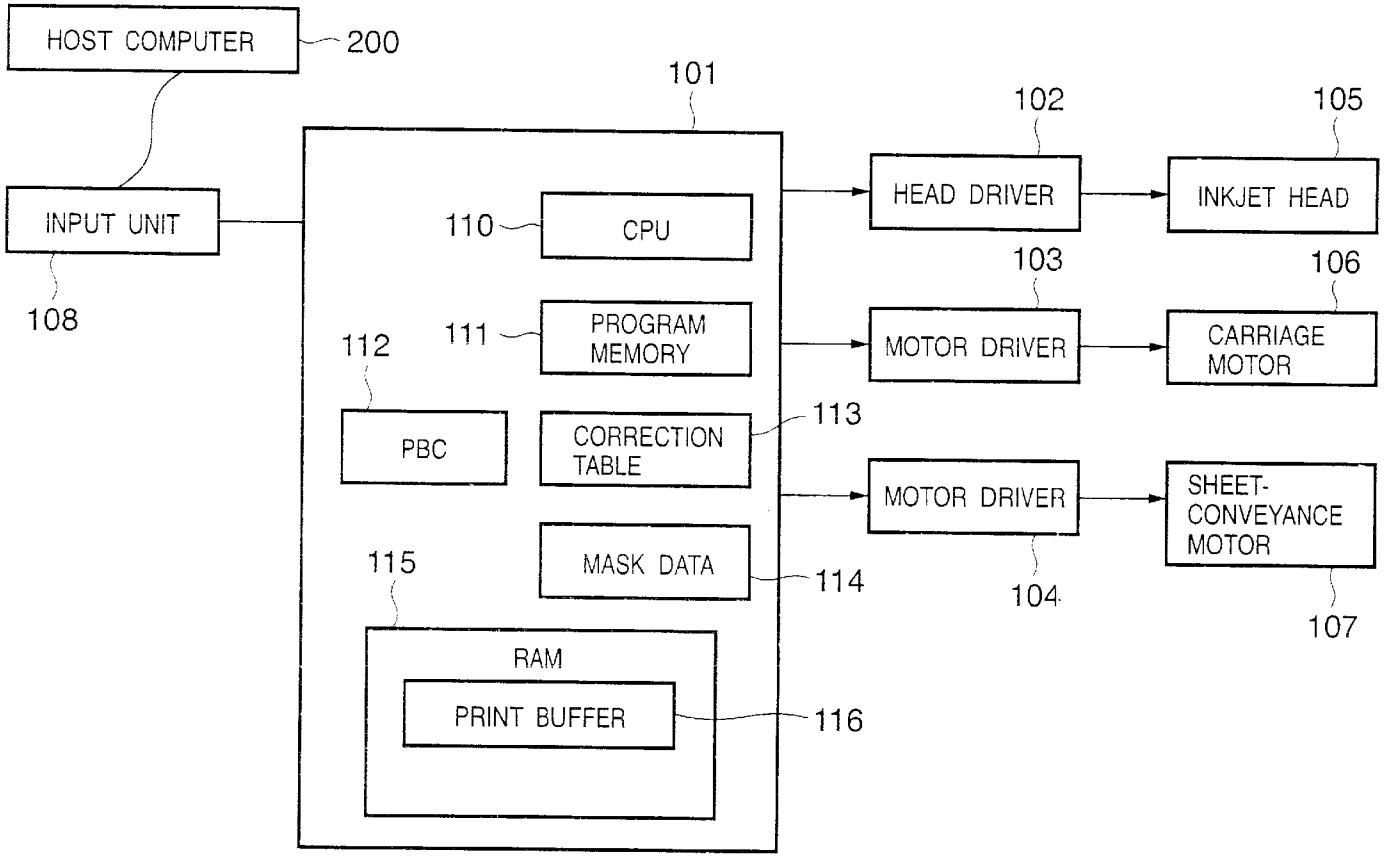
FIG. 3 is a block diagram showing a construction of an inkjet printer according to an embodiment of the present invention.

FIG. 3 is a block diagram showing a basic construction of the inkjet printer 100 according to the embodiment. Note that the following description of the inkjet printer 100 is given on the case where the inkjet printer 100 has the image processing function described in FIG. 2. However, in a case where the printer driver 221 of the host computer 200 has this function, the inkjet printer would naturally have a simpler structure without the image processing function.

Referring to FIG. 3, reference numeral 101 denotes a control unit for controlling the entire operation of the inkjet printer of the embodiment. Reference numeral 102 denotes a head driver for performing printing by driving an inkjet head 105 based on print data transmitted by the control unit 101. Reference numerals 103 and 104 denote motor drivers for respectively driving a carriage motor 106 and a sheet-conveyance motor 107. Reference numeral 108 denotes an input unit which inputs image data from an external apparatus, such as the host computer 200, and sends it to the control unit 101.

Next, the construction of the control unit 101 is described.

Reference numeral 110 denotes a CPU such as a microprocessor or the like; numeral 111 denotes a program memory storing a program or the like executed by the CPU 110; and numeral 115 denotes a RAM having a work area for writing various data when the CPU 110 operates and having a print buffer 116 for storing print data. Reference numeral 112 denotes a print buffer controller (PBC) which controls to extract print data to be printed out of the print buffer 116. Reference numeral 113 denotes the aforementioned correction table (FIG. 2); and numeral 114 denotes mask data used for determining print data to be printed in each scan of the inkjet head 105.

Figure 4:
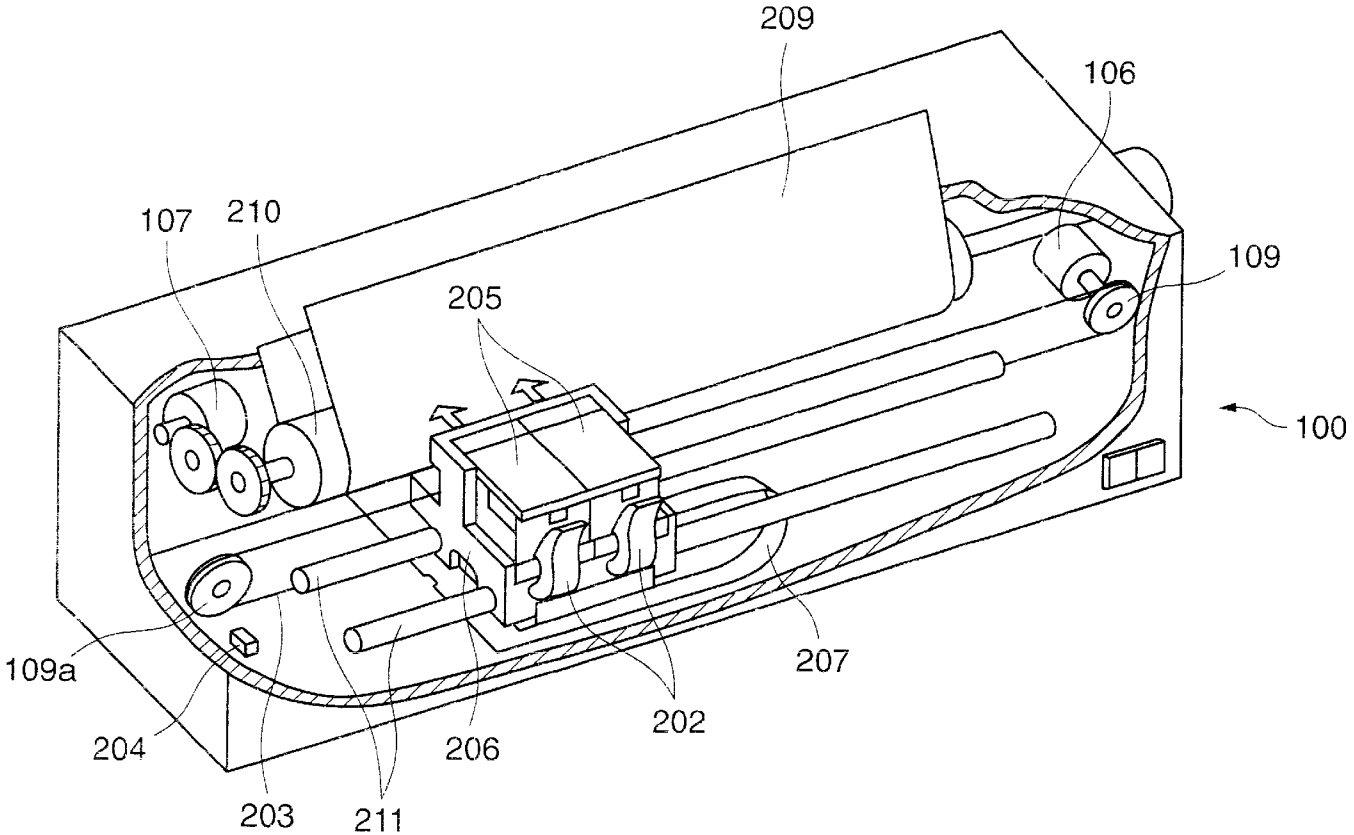
FIG. 4 is a view showing a construction of a printing unit of a serial-type inkjet printer according to an embodiment of the present invention.

FIG. 4 is an explanatory view showing a construction of a printing unit of the inkjet printer 100 according to the embodiment of the present invention.

Referring to FIG. 4, reference numeral 205 denotes a head cartridge, integrally comprising an inkjet head (105 in FIG. 3) and an ink tank which serves as an ink supply source. The head cartridge 205 is fixed on top of the carriage 206 by pressuring members 202. The carriage 206 is slidably fixed to shafts 211. A belt 203 is wrapped around between a pulley 109, provided in the rotation axle of the carriage motor 106, and another pulley 109*a*, and a part of the belt 203 is fixed to the carriage 206. With this structure, when the carriage motor 106 is driven, the carriage 206 can reciprocally move along the shafts 211. In synchronization with the scanning of the carriage 206, the inkjet head 105 of the head cartridge 205 is driven through the head driver 102 (FIG. 3) to discharge ink in accordance with print data, thereby printing a desired image on a print sheet 209 which is wrapped around a platen 210 to serve as a print surface. Note that the platen 210 is rotated by rotation of the sheet conveyance motor 107.

Reference numeral 207 denotes a cable. Through the cable 207 and a terminal connected thereto, print data to be printed is supplied from the control unit 101 to the head cartridge 205. The head cartridge 205 may include one or plural inkjet heads in accordance with ink colors to be used. In the embodiment, four colors (C, M, Y and K) are used so that four inkjet heads are provided. Reference numeral 204 denotes a home position (HP) sensor which detects the carriage 206 at the home position.

Next, print data generation processing (image processing) corresponding to each pass, performed by the printer driver 221 of the embodiment, is described with reference to the flowchart in FIG. 5. Note that this processing may be performed by the inkjet printer 100 as mentioned above.

At step S1, R, G and B image data (8 bits each) is inputted from the application program 220. At step S2, the image data is converted to C, M, Y and K color data (8 bits each). At step S3, it is determined whether or not the C, M, Y and K data represent a character pattern. In the case of a character pattern, the control proceeds to step S5 to make a setting to perform printing only when the carriage 206 scans in one direction (e.g., forward direction), in which cockling or a satellite is generated always in a fixed direction, so that outlines of the character are clearly printed. If the data does not represent a character pattern, the process proceeds to step S4, then it is determined at step S4 whether or not the density of the image data is higher than a predetermined value. If so, the control proceeds to step S6. If not, the control proceeds to step S5, and image data for the first and third passes are generated to perform printing only in the first and the third passes (main-scanning (forward) direction) of multi-pass (4-pass) printing which will be described later. Namely, in order to print an image to be printed on an area of the printing medium by two scans (the first and second passes) of the inkjet head, image data of the image is divided in accordance with the number of scans and printing data corresponding to each scan is generated.

Meanwhile, in a case where the density of the image data is high and where cockling or a satellite is superimposed on the neighboring pixel dots of a tonality pattern thus becomes inconspicuous even when printing is performed in both forward and backward directions, the control proceeds to step S6 where image data for each of the four passes is generated. At step S7, the image data is corrected, if necessary, based on the correction table 113 provided for each pass.

Upon execution of step S7, the control proceeds to step S8 where the image data for each pass is quantized to generate print data, in which one pixel is expressed by one bit, indicative of dot existence/absence. At step S9, the generated print data is stored in the RAM 115. At step S10, it is determined whether or not the image data, inputted at step Si, has all been converted. If not, the control returns to step S3 for repeating the above-described processing.

In the foregoing manner, print data to be printed in each pass of the inkjet printer 100 is generated, transmitted to the printer 100, and printed on a print sheet. As mentioned above, this processing may be performed by the printer driver 221 or the inkjet printer 100 according to the embodiment of the present invention. In a case where the inkjet printer 100 performs this processing, the host computer 200 outputs R, G, and B image data without conversion.

Figure 5:
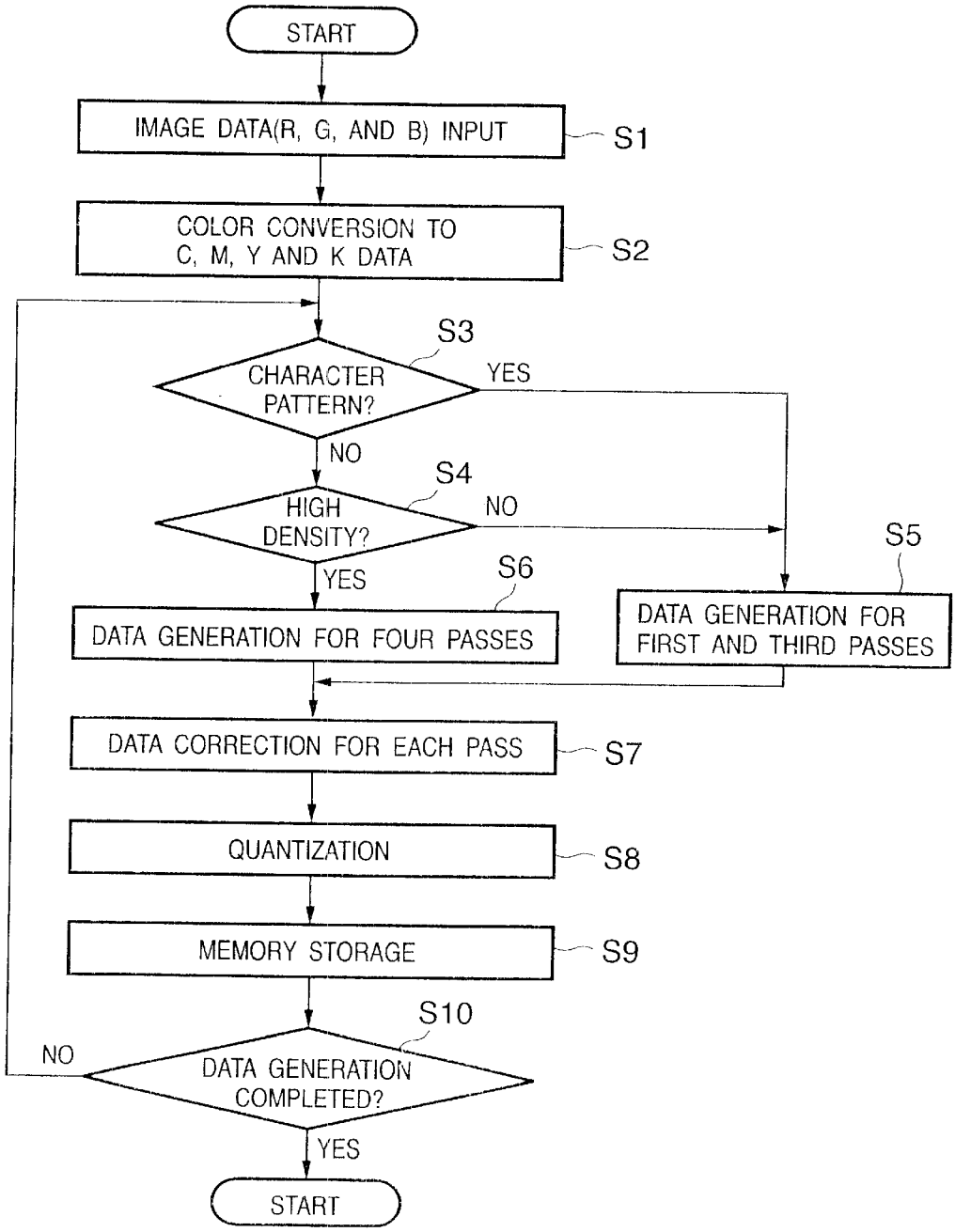
FIG. 5 is a flowchart explaining image processing of the printer driver according to an embodiment of the present invention.

Note in the flowchart shown in FIG. 5, processing at step S3 can be omitted. In such case, the above-described determination is made based only on the density value of an image data and the scanning direction of the inkjet head is determined for printing. In other words, if the density value of an image data to be printed for an area is not less than a predetermined value, then printing is performed in both forward and backward directions (first print mode for performing bi-directional printing), otherwise, printing is performed in only one direction (second print mode for performing unidirectional printing).

[First Embodiment]

Figure 6A:
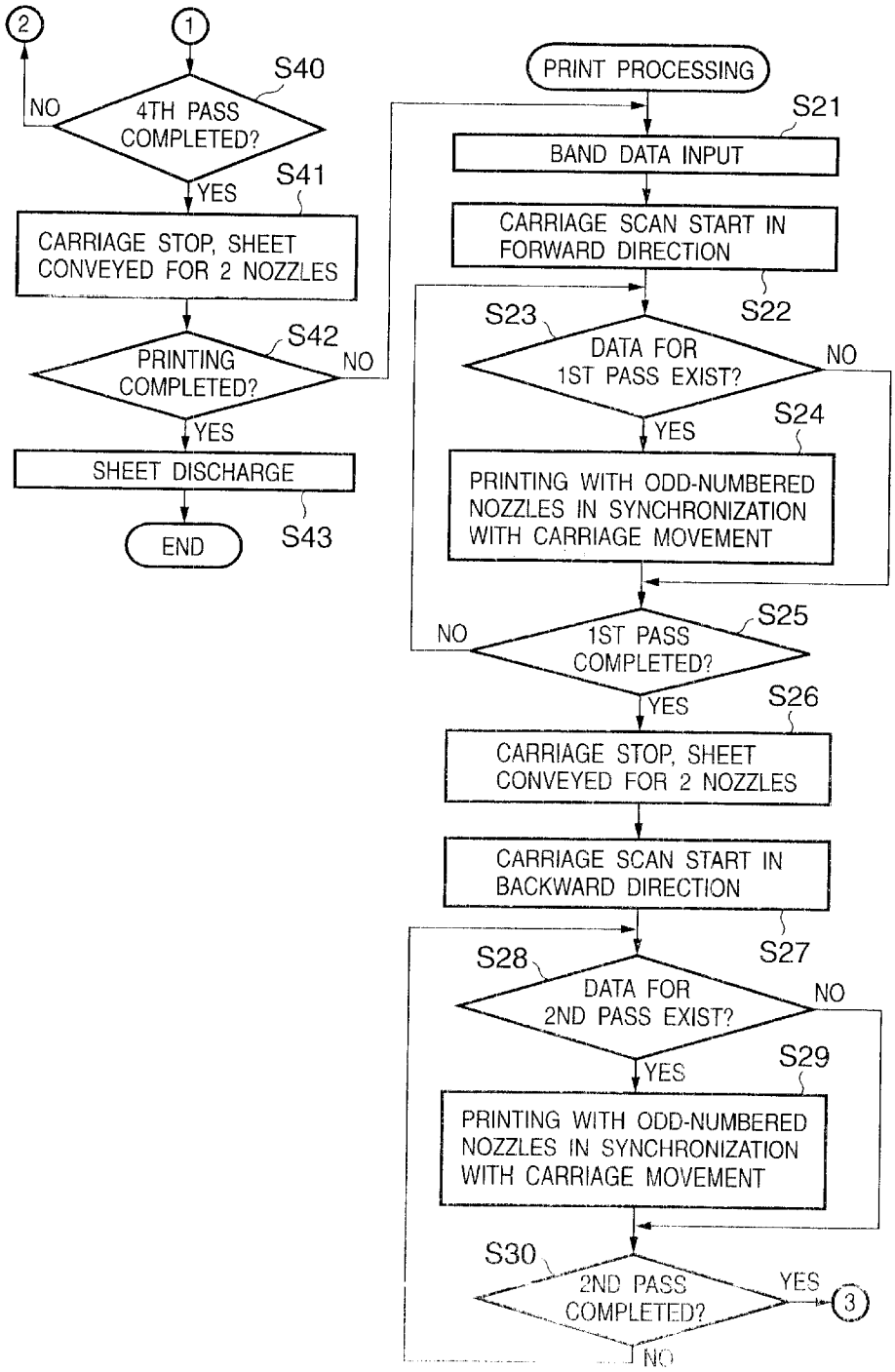
FIGS. 6A and 6B are flowcharts explaining print processing of the inkjet printer according to an embodiment of the present invention.
Figure 6B:
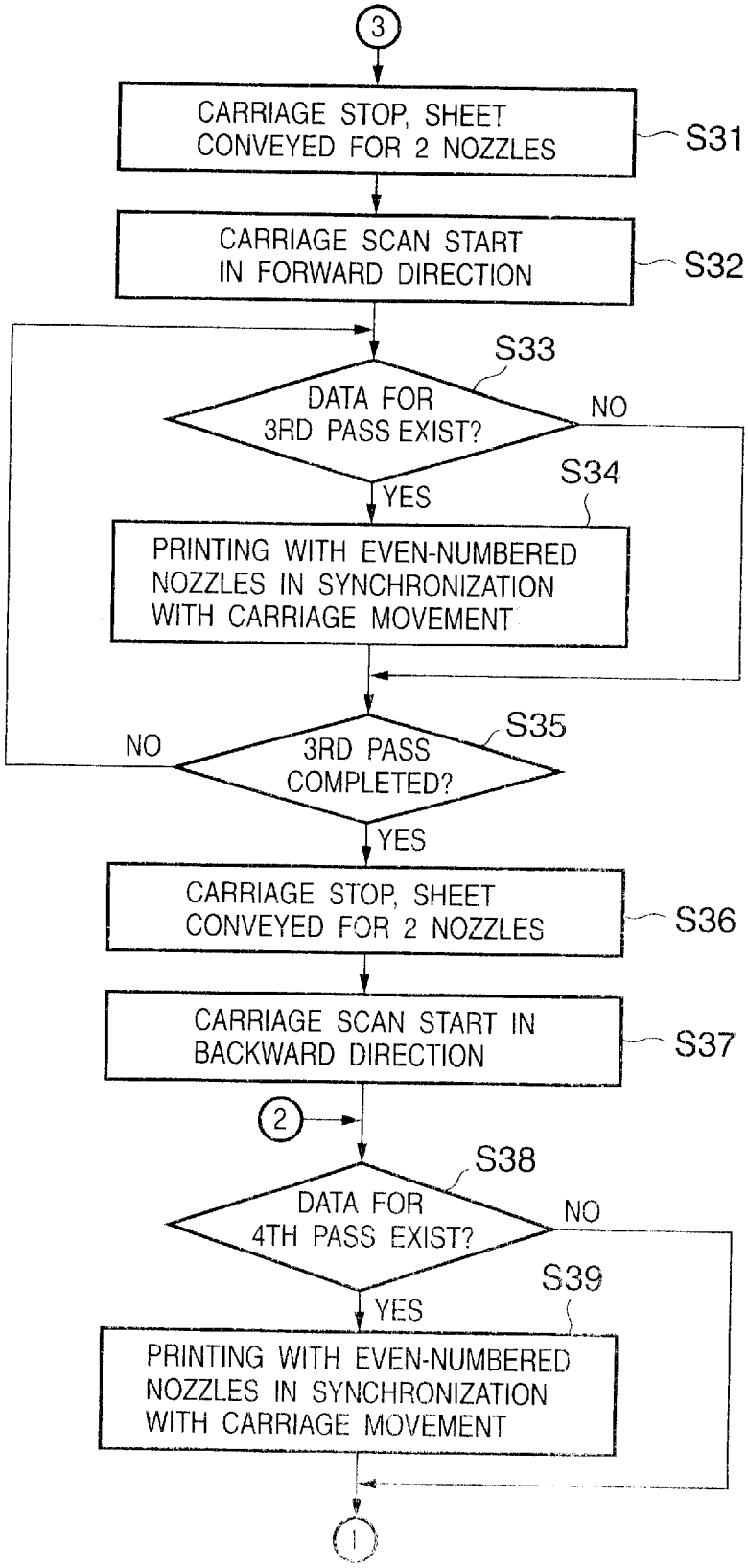

FIGS. 6A and 6B are flowcharts explaining print processing of the inkjet printer 100 according to the first embodiment of the present invention. FIGS. 7A to 7D are schematic views of 4-pass print processing using an inkjet head 700 having 8 nozzles.

Figures 7A, 7B, 7C, 7D:
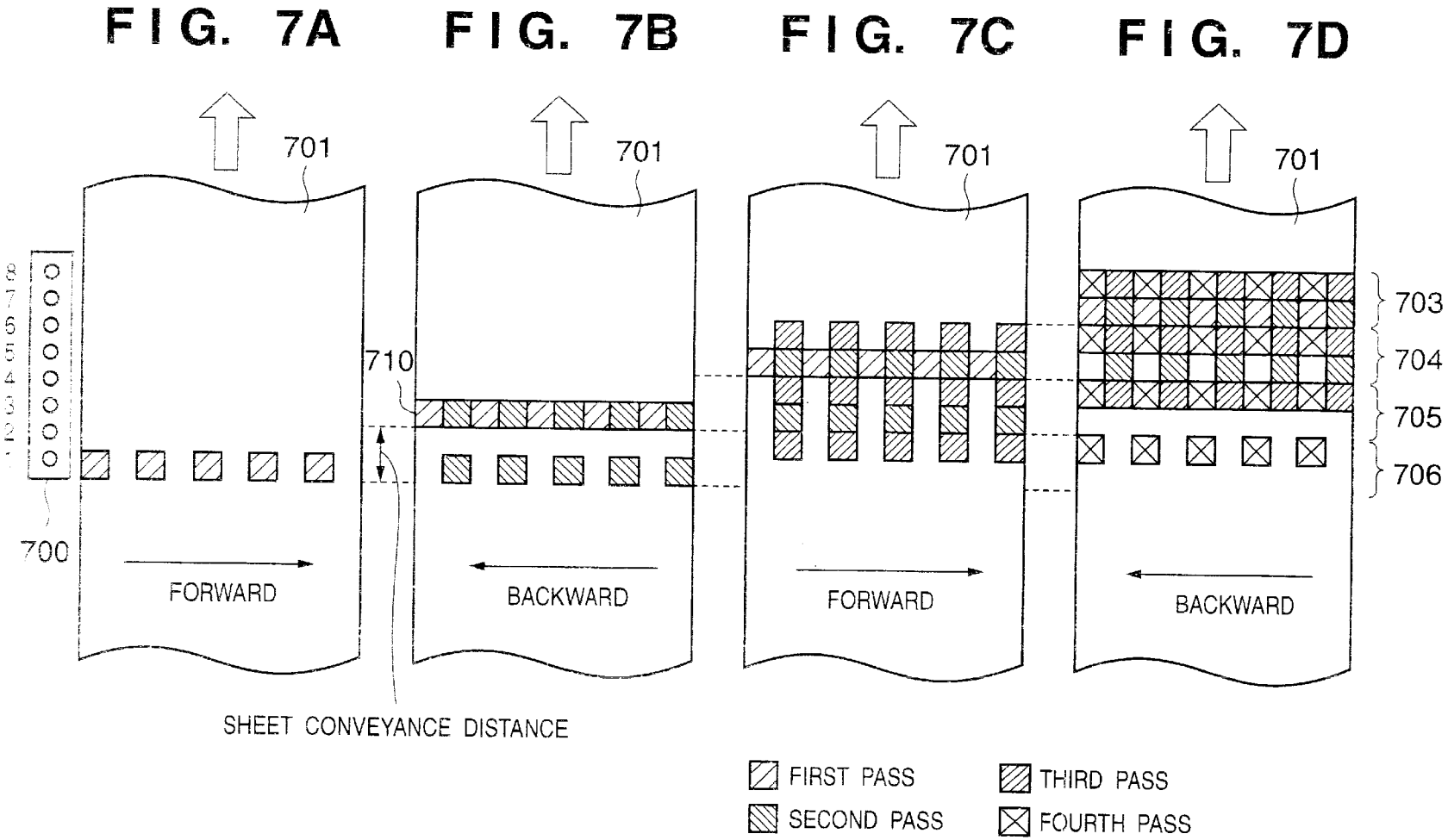
FIGS. 7A to 7D are schematic views of 4-pass print processing of the inkjet printer according to an embodiment of the present invention.

In FIGS. 7A to 7D, the inkjet head 700 is reciprocally moved in the main-scanning direction, and a print sheet 701 is conveyed upward of FIG. 7 (sub-scanning direction) at each scan by a distance of two nozzles.

FIG. 7A shows dots printed by the initial first pass. In the first pass, the first (odd-numbered) nozzle (No. 1) prints odd-numbered dots of the main-scanning (forward) direction. Upon completing the printing of the first pass, the print sheet 701 is conveyed by a distance of two nozzles in the sub-scanning direction indicated by the arrow in FIG. 7B. Then, printing for the second pass is performed while the inkjet head 700 scans in the backward direction. In the second pass, odd-numbered nozzles (Nos. 1 and 3) of the head 700 print the even-numbered dots of the main-scanning (forward) direction. As a result, printing for a line 710 is completed.

Upon completing the printing of the second pass, the print sheet 701 is conveyed by a distance of two nozzles in the sub-scanning direction. Then, while the inkjet head 700 scans in the forward direction, printing for the third pass is performed where the even-numbered nozzles (Nos. 2, 4 and 6) of the head 700 print the even-numbered dots of the main-scanning (forward) direction as shown in FIG. 7C. Upon completing the printing of the third pass, the print sheet 701 is conveyed by a distance of two nozzles in the sub-scanning direction. Then, printing for the fourth pass is performed while the inkjet head 700 scans in the backward direction as shown in FIG. 7D. In the fourth pass, the even-numbered nozzles (Nos. 2, 4, 6, and 8) of the head 700 print the odd-numbered dots of the main-scanning (forward) direction. Upon completing the printing of the fourth pass, printing of the initially printed image area 703 corresponding to lines for two dots is completed.

The foregoing processing is repeated for the ensuing data. The image area 704 is printed in the next first pass, the image area 705 in the next second pass, and the image area 706 in the next third pass.

Next, multi-pass print processing by the inkjet printer 100 according to the first embodiment is described with reference to the flowchart in FIGS. 6A and 6B.

At step S21, print data for plural bands (e.g., four bands) is inputted by the printer driver 221. At step S22, the carriage motor 106 starts driving and the carriage 206 starts scanning in the main-scanning (forward) direction. At step S23, it is determined whether or not there is print data to be printed in the first pass. If not, the control proceeds to step S25. Meanwhile, if there is print data to be printed in the first pass, the control proceeds to step S24 where the odd-numbered nozzles of the inkjet head 105 are driven in synchronization with the movement of the carriage 206 to print the odd-numbered dots of the main-scanning direction, and the control proceeds to step S25. At step S25, it is determined whether or not the first-pass scanning of the carriage 206 in the forward direction is completed. If not, the control returns to step S23 for printing the next print data in the first pass. When printing for the first pass is completed, the control proceeds to step S26 where the movement of the carriage 206 is halted, and the print sheet 701 is conveyed by a distance of two nozzles in the sub-scanning direction by driving the sheet conveyance motor 107.

Next at step S27, printing for the second pass begins. In the second pass, the carriage 206 starts scanning in the backward direction. At step S28, it is determined whether or not there is print data to be printed in the second pass. If there is print data to be printed in the second pass, the control proceeds to step S29 where the odd-numbered nozzles of the inkjet head 105 are driven in synchronization with the movement of the carriage 206 to print the even-numbered dots of the main-scanning direction, and the control proceeds to step S30. At step S30, it is determined whether or not the second-pass scanning of the carriage 206 i n the backward direction is completed. If not, the control returns to step S28 for printing the next print data in the second pass. When printing for the second pass is completed, the control proceeds to step S31 where the movement of the carriage 206 is halted, and the print sheet 701 is conveyed by a distance of two nozzles in the sub-scanning direction by driving the sheet conveyance motor 107.

Next at step S32, printing for the third pass begins. In the third pass, the carriage 206 starts scanning in the forward direction. At step S33, it is determined whether or not there is print data to be printed in the third pass. If there is print data to be printed, the control proceeds to step S34 where the even-numbered nozzles of the inkjet head 105 are driven in synchronization with the movement of the carriage 206 to print the even-numbered dots of the main-scanning direction, and the control proceeds to step S35. At step S35, it is determined whether or not the third-pass scanning of the carriage 206 in the forward direction is completed. If not, the control returns to step S33 for printing the next print data in the third pass. When printing for the third pass is completed, the control proceeds to step S36 where the movement of the carriage 206 is halted, and the print sheet 701 is conveyed by a distance of two nozzles in the sub-scanning direction by driving the sheet conveyance motor 107.

Next at step S37, printing for the fourth pass begins. In the fourth pass, the carriage 206 starts scanning in the backward direction. AT step S38, it is determined whether or not there is print data to be printed in the fourth pass. If there is print data to be printed, the control proceeds to step S39 where the even-numbered nozzles of the inkjet head 105 are driven in synchronization with the movement of the carriage 206 to print the odd-numbered dots of the main-scanning direction, and the control proceeds to step S40. At step S40, it is determined whether or not the fourth-pass scanning of the carriage 206 in the backward direction is completed. If not, the control returns to step S38 for printing the next print data in the fourth pass. When printing for the fourth pass is completed, the control proceeds to step S41 where the movement of the carriage 206 is halted, and the print sheet 701 is conveyed by a distance of two nozzles in the sub-scanning direction by driving the sheet conveyance motor 107. At step S42, it is determined whether or not there is next image data to be printed. If there is image data to be printed, the control proceeds to step S21 to execute the above-described processing. When image printing for one page is completed in the foregoing manner, the control proceeds to step S43 where the printed sheet is discharged, and the print processing ends.

As has been described above, the inkjet printer, printer driver which realizes the inkjet control method, and inkjet control apparatus, such as a computer or the like executing the printer driver, according to the first embodiment achieve an effect of reducing an influence unique to inkjet printing, such as cockling or the like, thereby enabling to obtain high-quality images. This effect is achieved by generating dot data to be printed in multi-pass printing in accordance with a density of an image or the type of image to be printed. More specifically, for a high-density (dark) image area, printing is performed in reciprocal directions of the passes, whereas for an image area such as a high-lighted area or a character area, printing is performed only in one scanning direction so that cockling or a satellite is generated uniformly.

[Second Embodiment]

In the above-described first embodiment, dot's assignment for each pass is regular as shown in FIG. 8A. However, the present invention is not limited to this case. For instance, dot's assignment for each pass may be random as shown in FIG. 8B. Note that each of the numerals in FIGS. 8A and 8B indicates a pass number in which the pixel (dot) is printed. The second embodiment can basically be realized with the same construction of the inkjet printer as that of the first embodiment.

The arrangement of the dots printed in the second embodiment may be realized by, for instance, changing the mask data 114 in the inkjet printer 100, or the output correction unit 303 shown in FIG. 2 is controlled to generate such data for each pass.

[Third Embodiment]

Next, a description is provided on data in the correction table storing correction data corresponding to each pass according to the third embodiment of the present invention.

Figure 9:
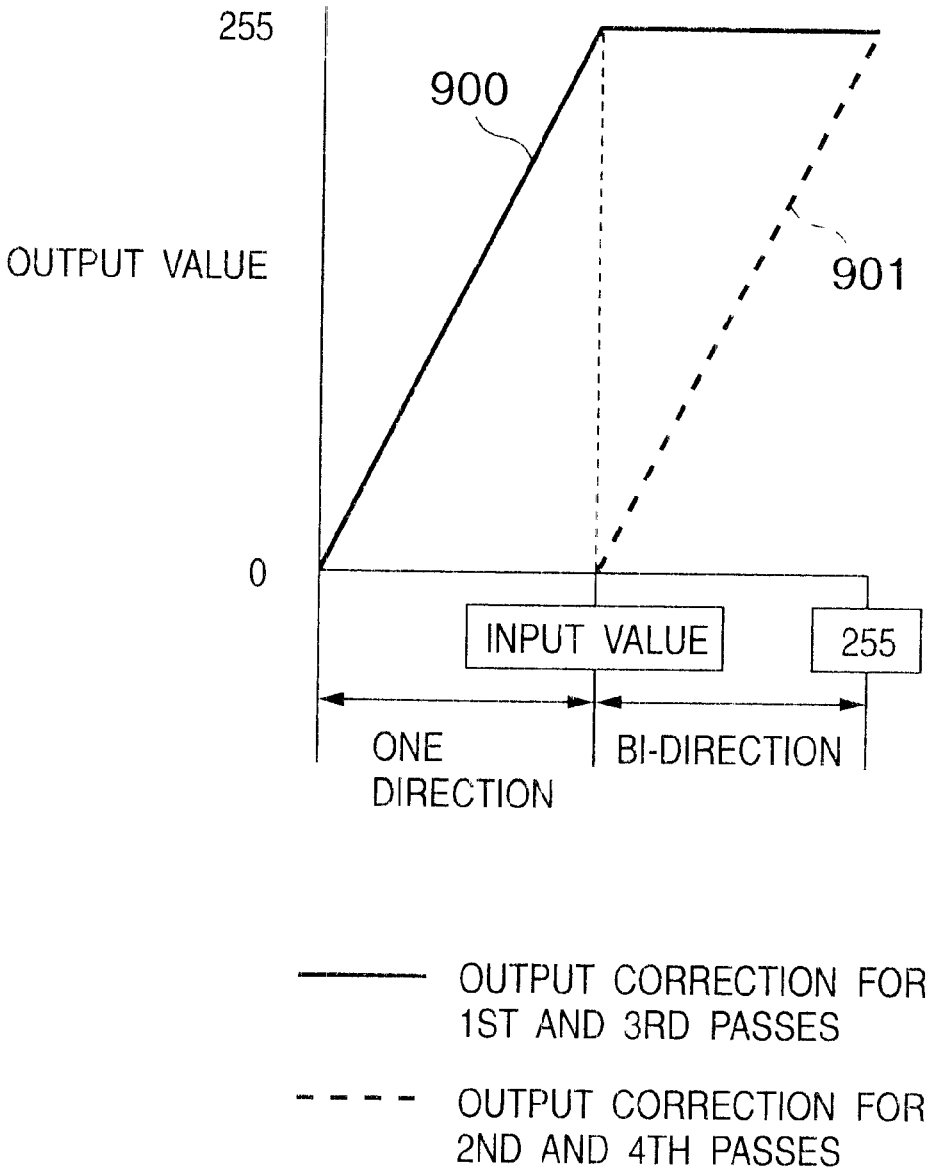
FIG. 9 is a graph explaining a correction value of each pass for an input pixel value according to a third embodiment of the present invention.
Figure 10:
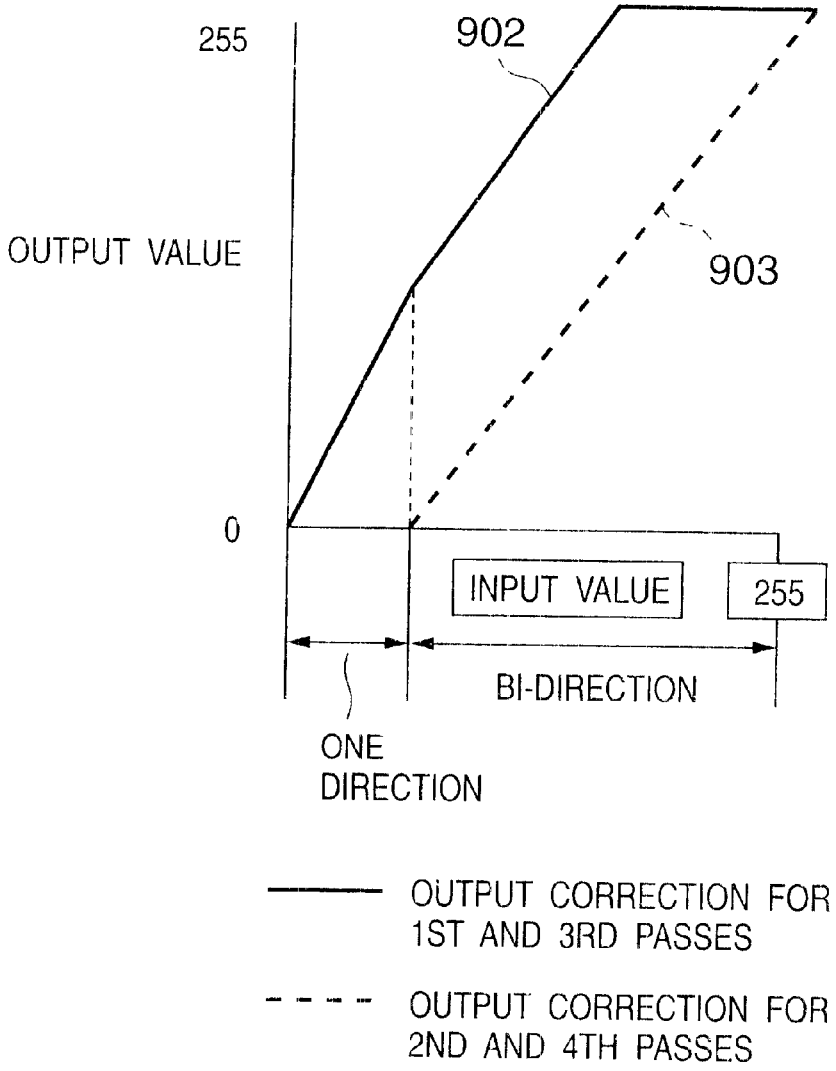
FIG. 10 is a graph explaining a correction value of each pass for an input pixel value according to the third embodiment of the present invention.

FIGS. 9 and 10 are graphs designating an output image value corresponding to an input image value in the correction table 113, which is referred to by the output correction unit 303 according to the third embodiment of the present invention.

FIG. 9 shows a case where an input pixel having a density value lower than 128, a half of the density of the inputted 8-bit pixel, is printed only in one direction of scans (e.g., aforementioned first and third passes) and an input pixel having a density value higher than 128 is printed in the first to fourth passes of bi-directional scans. In FIG. 9, reference numeral 900 denotes a correction value corresponding to the first and third passes, and 901 denotes a correction value corresponding to the second and fourth passes.

FIG. 10 shows a case where an input pixel having a density value lower than 64, substantially a quarter of the density of the inputted 8-bit pixel, is printed only in one direction of scans (e.g., aforementioned first and third passes) and an input pixel having a density value higher than 64 is printed in the first to fourth passes of bi-directional scans. In FIG. 10, reference numeral 902 denotes a correction value corresponding to the first and third passes, and 903 denotes a correction value corresponding to the second and fourth passes.

Note in FIGS. 9 and 10, although the correction values are the same for the first and third passes, and the second and fourth passes respectively, the present invention is not limited to this case, and a correction value may differ for each pass.

Figure 11:
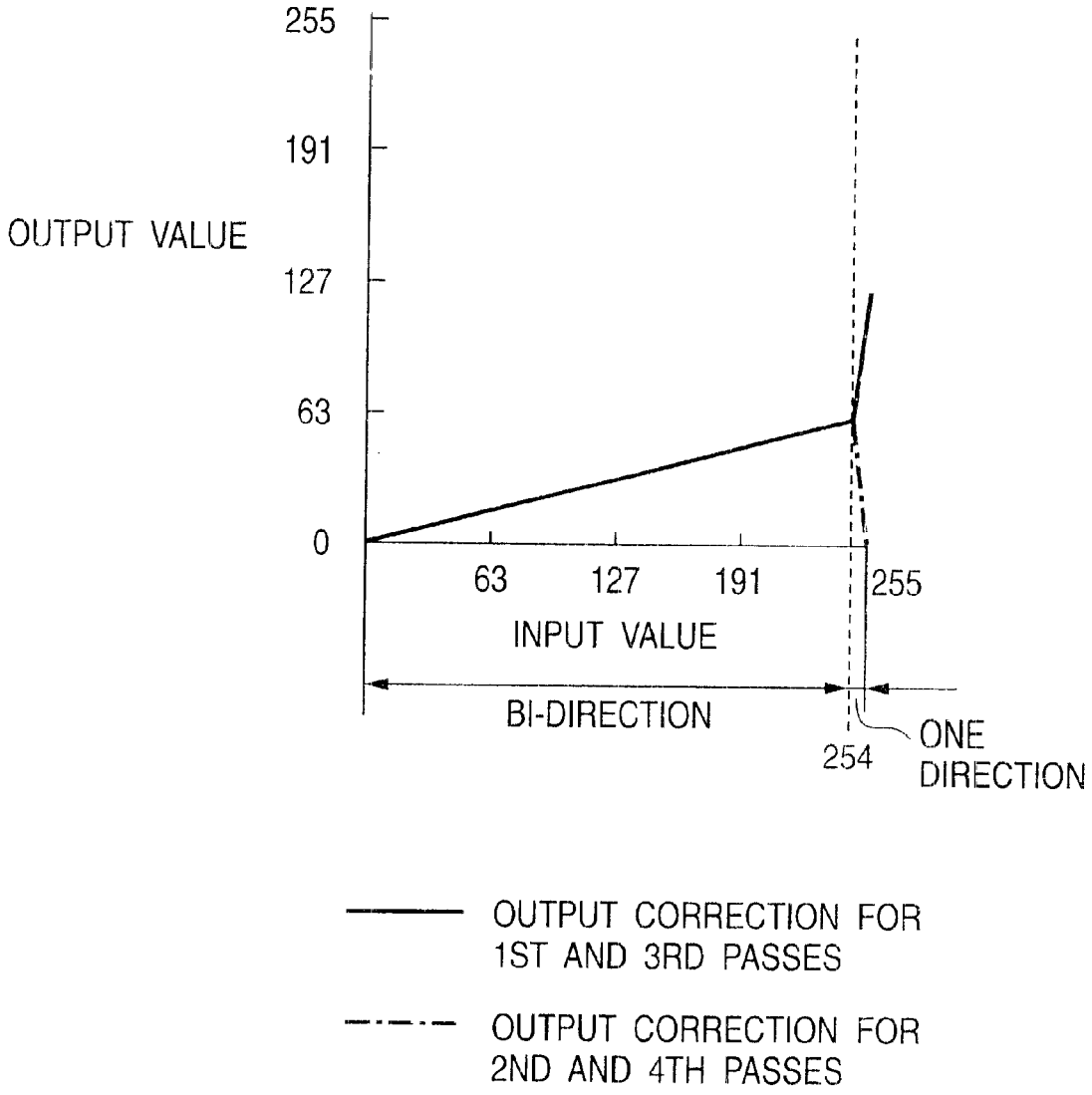
FIG. 11 is a graph explaining a correction value of each pass for an input pixel value of black data according to the third embodiment of the present invention.

FIG. 11 explains a method of printing a black character area. As shown in FIG. 11, an input pixel having a density value of 0 to 254 is printed in bi-directional scans, and an input pixel having a density value of 255 is printed only in one direction of scans.

Whether or not inputted image data is a black character is determined based on whether or not black density data is 100%. In a case of using a printer having a resolution of 600 dpi, the printer can print a black character image by forming one dot per pixel. However, in reality, each pixel is printed in the first to fourth passes of bi-directional scans. Therefore, output values of the output correction table for black data 255 is 64, 64, 64, and 63 for respective passes. Although 400% printing is possible by printing dots in each of the passes, the third embodiment assumes that the maximum of 100% printing is performed in four passes.

Therefore, for one pixel, dots are printed in each pass with the probabilities of 64/255, 64/255, 64/255, and 63/255. Ultimately, dots are printed in four passes with the probability of 255/255.

To print 100% black while the carriage (printhead) scans in one direction, inputted density values 0 to 254 take the above-described output values. For an input density value 255, an output value of the first pass is 128, an output value of the second pass is 0, an output value of the third pass is 127, and an output value of the fourth pass is 0. As a result, dots are printed only in the first and third passes (forward direction), enabling one-directional printing. Since the hardware constructions of the printer driver 221 and printer 100 are basically the same as that of the first embodiment, detailed descriptions thereof are omitted.

Although the lines indicative of correction values in FIGS. 9 to 11 are expressed by substantially straight lines, in reality, these correction values are expressed by functions having a high order.

Note that the above-described embodiments are applicable to a case where a resolution of inputted image data is, for instance, 600 dpi, and a printing resolution of the inkjet printer is 600 dpi. The embodiments are also applicable to a case where a resolution of inputted image data is, for instance, 600 dpi, and a printing resolution of the inkjet printer is 1200 dpi, wherein one pixel is expressed by 2×2 dots.

In the above-described embodiments, the threshold value of the image density, which is used for determining whether or not printing is to be performed only in one direction, is substantially a half or a quarter of the maximum value. However, the threshold value may be changed in accordance with each color component, in a case where a color image is printed by using, e.g., C, M, Y and K ink. Since colors such as yellow do not make a satellite stand out, the threshold value may be set high, whereas for dark colors like cyan or magenta, it is preferable to set the threshold value low.

Each of the embodiments described above has exemplified a printer, which comprises means (e.g., an electrothermal transducer, laser beam generator, and the like) for generating heat energy as energy utilized upon execution of ink discharge, and adopts a printing method that causes a change in state of ink by the heat energy among inkjet printing methods. However, the similar effect can be attained when employing, for instance, a piezoelectric inkjet printing method disclosed in Japanese Patent Publication No. 6-6357. According to this inkjet printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Application Laid-Open No. 59-123670 which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

In addition, the ink-jet printer of the present invention may be used in the form of a copying machine combined with a reader, and the like, or a facsimile apparatus having a transmission/reception function, in addition to an integrally-provided or stand-alone image output terminal of an information processing equipment such as a computer.

The present invention can be applied to a system constituted by a plurality of devices (e.g., host computer, interface, reader, printer) or to an apparatus consisting of a single device (e.g., copying machine, facsimile machine).

Further, the object of the present invention can also be achieved by providing a storage medium, storing program codes of a software realizing the above-described functions of the embodiments, to a computer system or apparatus, reading the program codes, by a computer (CPU or MPU) of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or the entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or the entire process in accordance with designations of the program codes and realizes functions of the above embodiments.

Although each of the above-described embodiments is described independently, the constructions described in the foregoing embodiments may be put into practice independently or in combination as appropriate.

According to the inkjet printer of the present embodiments, it is possible to print a high-quality image by eliminating an influence of the aforementioned cockling or satellite or the like, when an image is printed by multi-pass printing where an inkjet printhead is reciprocally scanned.

Further, the inkjet printer of the present embodiments can print while the printhead scans in a predetermined direction in accordance with the type of an image, so as to reproduce clear edges of an image, such as a character or the like.

The inkjet printer of the present embodiments performs high-quality image printing by printing a relatively light portion of an image, where print dots are distributed, while a printhead scans in one direction, and prints a high-density portion of an image, where dots are dense, while the printhead scans reciprocally.

The present invention is not limited to the above embodiments and various changes and modifications can be made within the spirit and scope of the present invention. Therefore, to apprise the public of the scope of the present invention, the following claims are made.

What is claimed is:

1. An inkjet printer for scanning an inkjet head having a plurality of nozzles arrayed in a first direction, in a second direction crossing the first direction, and for printing an image on a print medium in relative scanning of the inkjet head, comprising:

determination means for determining whether or not a density value represented by pixel data of an image data is higher than a predetermined value; and selection means for selecting either a first print mode or a second print mode, wherein in the first print mode, printing is performed in bi-directional scanning and in the second print mode, printing is performed in unidirectional scanning;

wherein in a case where said determination means determines the density value of the image data is higher than the predetermined value, said selection means selects the first print mode, and in a case where said determination means determines the density value of the image data is not higher than the predetermined value, said selection means selects the second print mode.

2. The inkjet printer according to claim 1, further comprising judging means for judging whether or not the image data is character pattern data, wherein in a case where said judging means judges that the image data is character pattern data, said selection means selects the second print mode.

3. The inkjet printer according to claim 1, further comprising data generation means for dividing image data corresponding to a predetermined area on the print medium to generate image data in correspondence to each scanning of the inkjet head, in a case where the inkjet head is scanned in plural times over the area on the print medium so as to print the area.

4. The inkjet printer according to claim 3, further comprising correction means for correcting the image data in correspondence to each scanning.

5. The inkjet printer according to claim 3, wherein in each scanning of the inkjet head, at least one of nozzle to be used for printing and dot position to be printed is changed.

6. The inkjet printer according to claim 3, further comprising conveyance means for conveying the print medium in a direction crossing to the second direction at a distance in each scanning of the inkjet head, wherein the distance is corresponding to a length of the number of nozzles of the inkjet head divided by the number of scanning to the predetermined area.

7. The inkjet printer according to claim 3, wherein pixel positions printed in each scanning of the inkjet head differ from each other.

8. The inkjet printer according to claim 1, wherein said determination means determines whether a density of the image data is less than a half of the maximum density in which the image data represents, wherein in a case where said determination means determines that the density of the image data is less than a half of the maximum density, said selection means selects the second print mode, in a case where said determination means determines that the density of the image data is not less than a half of the maximum density, said selection means selects the first print mode.

9. The inkjet printer according to claim 1, wherein said determination means determines whether a density of the image data is less than a quarter of the maximum density in which the image data represents, wherein in a case where said determination means determines that the density of the image data is less than a quarter of the maximum density, said selection means selects the second print mode, in a case where said determination means determines that the density of the image data is not less than a quarter of the maximum density, said selection means selects the first print mode.

10. An inkjet printing method for scanning an inkjet head having a plurality of nozzles arrayed in a first direction, in a second direction crossing the first direction, and for printing an image on a print medium in relative scanning of the inkjet head, comprising:

a determination step of determining whether or not a density value represented by pixel data of an image data is higher than a predetermined value; and a selection step of selecting either a first print mode or a second print mode, wherein in the first print mode, printing is performed in bi-directional scanning and in the second print mode, printing is performed in unidirectional scanning;

wherein in a case where in said determination step, it is determined that the density value of the image data is higher than the predetermined value, in said selection step, the first print mode is selected, and in a case where in said determination step, it is determined that the density value of the image data is not higher than the predetermined value, in said selection step, the second print mode is selected.

11. The method according to claim 10, further comprising a judging step of judging whether or not the image data is character pattern data, wherein in a case where in said judging step, it is judged that the image data is character pattern data, in said selection step, the second print mode is selected.

12. The method according to claim 10, further comprising a data generation step of dividing image data corresponding to a predetermined area on the print medium to generate image data in correspondence to each scanning of the inkjet head, in a case where the inkjet head is scanned in plural times over the area on the print medium so as to print the area.

13. The method according to claim 12, further comprising a correction step of correcting the image data in correspondence to each scanning.

14. The method according to claim 12, wherein in each scanning of the inkjet head, at least one of nozzle to be used for printing and dot position to be printed is changed.

15. The method according to claim 12, further comprising a conveyance step of conveying the print medium in a direction crossing to the second direction at a distance in each scanning of the inkjet head, wherein the distance is corresponding to a length of the number of nozzles of the inkjet head divided by the number of scanning to the predetermined area.

16. The method according to claim 12, wherein pixel positions printed in each scanning of the inkjet head differ from each other.

17. The method according to claim 10, wherein in said determination step, it is determined whether a density of the image data is less than a half of the maximum density in which the image data represents, wherein in a case where in said determination step, it is determined that the density of the image data is less than a half of the maximum density, in said selection step, the second print mode is selected, in a case where in said determination step, it is determined that the density of the image data is not less than a half of the maximum density, in said selection step, the first print mode is selected.

18. The method according to claim 10, wherein in said determination step, it is determined whether a density of the image data is less than a quarter of the maximum density in which the image data represents, wherein in a case where in said determination step, it is determined that the density of the image data is less than a quarter of the maximum density, in said selection step, the second print mode is selected, in a case where in said determination step, it is determined that the density of the image data is not less than a quarter of the maximum density, in said selection step, the first print mode is selected.

19. A program for executing the inkjet printing control method of an inkjet print apparatus for scanning an inkjet head having a plurality of nozzles arrayed in a first direction, in a second direction crossing the first direction, and for printing an image on a print medium in relative scanning of the inkjet head, comprising:

a determination step module of determining whether or not a density value represented by pixel data of an image data is higher than a predetermined value; and a selection step module of selecting either a first print mode or a second print mode, wherein in the first print mode, printing is performed in bidirectional scanning and in the second print mode, printing is performed in unidirectional scanning;

wherein in a case where in said determination step module, it is determined that the density value of the image data is higher than the predetermined value, in said selection step module, the first print mode is selected, and in a case where in said determination step module, it is determined that the density value of the image data is not higher than the predetermined value, in said selection step module, the second print mode is selected.

20. A computer readable recording medium for storing a program for executing the inkjet printing control method of an inkjet print apparatus for scanning an inkjet head having a plurality of nozzles arrayed in a first direction, in a second direction crossing the first direction, and for printing an image on a print medium in relative scanning of the inkjet head, comprising:

a determination step module of determining whether or not a density value represented by pixel data of an image data is higher than a predetermined value; and a selection step module of selecting either a first print mode or a second print mode, wherein in the first print mode, printing is performed in bidirectional scanning and in the second print mode, printing is performed in unidirectional scanning;

wherein in a case where in said determination step module, it is determined that the density value of the image data is higher than the predetermined value, in said selection step module, the first print mode is selected, and in a case where in said determination step module, it is determined that the density value of the image data is not higher than the predetermined value, in said selection step module, the second print mode is selected.

* * * * *